US010791606B2

(12) United States Patent
Hung et al.

(10) Patent No.: US 10,791,606 B2
(45) Date of Patent: Sep. 29, 2020

(54) LED TRAFFIC LIGHT

(71) Applicant: Hokyuen Hung, Shanghai (CN)

(72) Inventors: Hokyuen Hung, Shanghai (CN); Hokman Hung, Shanghai (CN)

( * ) Notice: Subject to any disclaimer, the term of this patent is extended or adjusted under 35 U.S.C. 154(b) by 0 days.

(21) Appl. No.: 16/487,680

(22) PCT Filed: Apr. 20, 2018

(86) PCT No.: PCT/CN2018/083838
§ 371 (c)(1),
(2) Date: Aug. 21, 2019

(87) PCT Pub. No.: WO2018/153387
PCT Pub. Date: Aug. 30, 2018

(65) Prior Publication Data

US 2020/0077475 A1 Mar. 5, 2020

(30) Foreign Application Priority Data

Feb. 22, 2017 (CN) ..... 2017 2 0164555 U

(51) Int. Cl.
*H05B 45/50* (2020.01)
*H05B 45/37* (2020.01)
*G08G 1/095* (2006.01)

(52) U.S. Cl.
CPC ..... *H05B 45/50* (2020.01); *H05B 45/37* (2020.01); *G08G 1/095* (2013.01)

(58) Field of Classification Search
None
See application file for complete search history.

(56) References Cited

U.S. PATENT DOCUMENTS 5,457,450 A * 10/1995 Deese ..... G08G 1/095 340/641
2006/0022916 A1* 2/2006 Aiello ..... H05B 33/0818 345/82
2019/0093863 A1* 3/2019 Lozeau ..... F21V 27/02

FOREIGN PATENT DOCUMENTS

CN 101896021 A 11/2010
CN 202056808 U 11/2011
CN 105065996 A 11/2015
(Continued)

OTHER PUBLICATIONS

English Machine Translation Abstract of CN202056808.
(Continued)

*Primary Examiner* — Jany Richardson
(74) *Attorney, Agent, or Firm* — Cantor Colburn LLP

(57) ABSTRACT

An LED traffic light driven by a control circuit, where the control circuit includes a driving power supply outputting direct current, and an accurate constant current module configured to perform accurately constant current processing for the direct current output by the driving power supply. The LED traffic light includes a plurality of conductive branches connected in parallel at an output end of the accurate constant current module, and each of the conductive branches is formed by connecting a power line with at least one light emitting diode. It is not necessary for the LED traffic light to connect a resistor in series or in parallel, and the light emitting diode can be driven directly by a direct current at a low voltage without the need for a built-in high-voltage AC/DC driving power supply.

17 Claims, 1 Drawing Sheet

(56) References Cited

FOREIGN PATENT DOCUMENTS

| | | |
|---|---|---|
| CN | 202269051 | 11/2017 |
| CN | 206620334 | 11/2017 |

OTHER PUBLICATIONS

English Machine Translation Abstract of CN101896021.
English Machine Translation Abstract of CN202269051.
English Machine Translation Abstract of CN206620334.
English Machine Translation Abstract of CN105065996.
Search Report for Application No. PCT/CN2018/083838.
Written Opinion for Application No. PCT/CN2018/083838.

* cited by examiner

LED TRAFFIC LIGHT

CROSS REFERENCE TO RELATED APPLICATIONS

This application is a National Stage of PCT Application No. PCT/CN2018/083838 filed on Apr. 20, 2018, which claims priority to Chinese Patent Application No. 201720164555.9 filed on Feb. 22, 2017, the contents each of which are incorporated herein by reference thereto.

TECHNICAL FIELD

The present application relates to the field of lighting electrical appliances, and in particular to an LED traffic light.

BACKGROUND

LED traffic lights are widely used in traffic of roads such as highways, railways and the like. At present, the LED traffic lights are mostly driven by built-in high-voltage AC/DC currents, and the following problems often occur during long-term use:

1) the power consumption is high, and the problem that the LED traffic lights are damaged due to heat is severe;

2) under the condition that the high-voltage AC is output by a backstage traffic signal control system, adopting the built-in high-voltage AC/DC current for drive is also prone to frequent faults such as open circuit/short circuit or the like, which is especially serious when a lamp body occurs water seepage or damp, or thunderstorms occurs;

3) the driving power of the LED traffic lights is subject to large transient high-voltage shock due to their frequently turning on/turning off, which causes that the LED traffic lights are prone to faults such as flicker, light decay, LED damage and the like, thereby seriously affecting their service life.

Technical Problem

A purpose of the present application is to overcome the above deficiencies of the prior art, and thus to provide an LED traffic light, which aims to improve working reliability, accuracy and safety of the LED traffic light.

SUMMARY

In order to solve the above technical problem, the technical solutions adopted by the LED traffic light of the present application are as follows:

an LED traffic light configured to be driven by a control circuit, where the control circuit includes a driving power supply configured for outputting direct current, and an accurate constant current module configured to perform accurately constant current processing for the direct current output by the driving power supply. The LED traffic light includes a plurality of conductive branches connected in parallel at an output end of the accurate constant current module, and each of the conductive branches is formed by connecting a power line with at least one light emitting diode.

Further, each of the conductive branches includes a plurality of light emitting diodes connected in series with each other, and two corresponding light emitting diodes of adjacent two of the conductive branches are connected in parallel, such that the plurality of light emitting diodes are distributed in a grid shape in the plurality of conductive branches.

Further, the control circuit further includes a processing unit outputting a control signal to the accurate constant current module.

Further, the processing unit is an MCU processing module.

Further, the processing unit is a CPU processor.

Further, a fault detection module is included, which is respectively connected to an output end of the driving power supply, an output end of the processing unit and an output end of the accurate constant current module such that the plurality of conductive branches are monitored.

Further, the voltage of the direct current output by the driving power supply is not higher than 60V.

Further, a lamp body provided with a circular lamp panel is included, and the light emitting diodes are disposed on the circular lamp panel.

Further, the light emitting diodes are distributed in a form of an annular array on the lamp panel.

Further, the driving power supply includes an AC/DC conversion module.

BENEFICIAL EFFECTS

Based on the above technical solutions, the LED traffic light, provided by the present application and compared with the prior art, adopts the driving power supply outputting the direct current, the accurate constant current module and the conductive branches provided only with the power line and the light emitting diode, there is no need for connecting a resistor in series or in parallel, thus the light emitting diode can be driven directly by a direct current at a low voltage without the need for a built-in high-voltage AC/DC driving power supply. Therefore, at least the following beneficial effects are provided:

1) the LED traffic light avoids the problems of transient high-voltage shock due to frequently turning on and turning off, and the open circuit, short circuit, emitting heat and easy damage of the AC/DC driving power supply, and can still keep working normally even if a housing of the lamp body of the LED traffic light occurs water seepage, which not only improves the working reliability, response accuracy, safety and energy saving of the LED traffic light, but also reduces the faults such as flicker, light decay or LED damage or the like accordingly, thereby greatly prolonging the service life of the LED traffic light;

2) the LED traffic light is supplied by a DC and has lower power consumption, which can not only greatly reduce cable cost, but also abandon relevant high-voltage components, thereby being capable of improving safety and reliability greatly and saving the overall production cost of the LED traffic light; and 3) the wiring is simple, and there is no need to reserve a space for arranging a driving power supply inside the LED traffic light during actual use, which can reduce the volume of the LED traffic light, and can also save a lot of installation and maintenance costs while saving the materials for manufacturing the housing of the LED traffic light.

DETAILED DESCRIPTION

In order to make the technical problem to be solved by the present application, the technical solutions and the beneficial effects more clear, the present application will be further described in detail below with reference to the accompanying drawings and embodiments. It should be understood that the specific embodiments described herein are merely used to illustrate the present application and are not intended to limit the present application.

It should be noted that, when an element is referred to as "being fixed on" or "being arranged on" another element, it can be directly on said another element or there may be an intermediate element at the same time. When an element is referred to as "being connected to" another element, it can be directly connected to said another element or there may be an intermediate element at the same time.

It should also be noted that, the orientation terms, such as left, right, upper, lower, inner, outer and the like in the following embodiments, are only relative concepts or reference to normal use state of a product, and thus should not be considered as restrictive.

Figure 1:
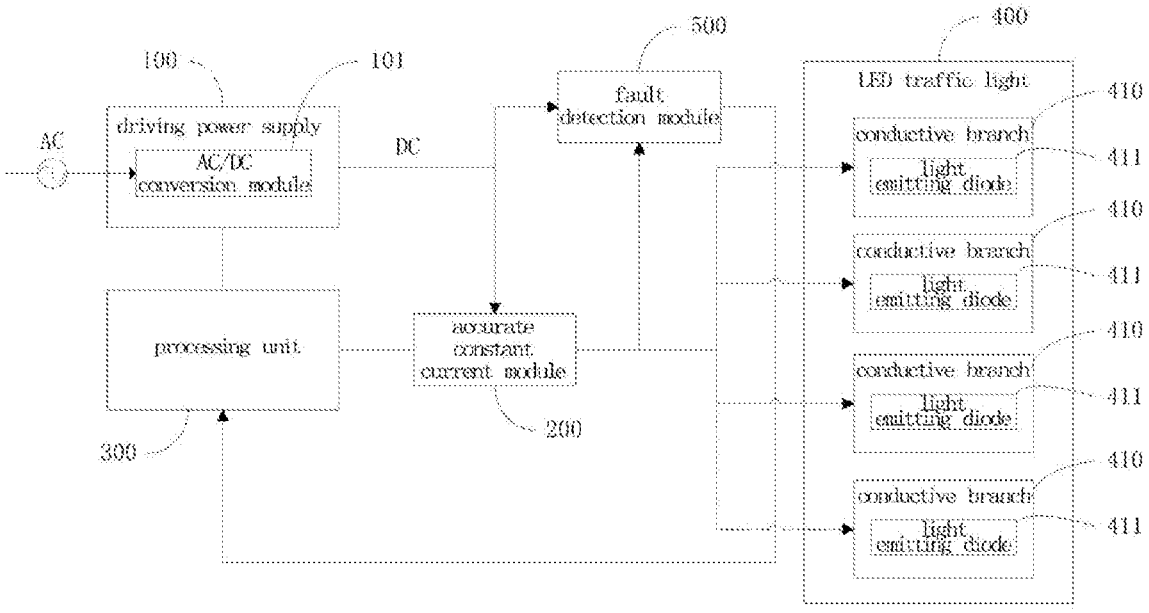
FIG. 1 is a structural diagram of the LED traffic light provided by an embodiment of the present application.
Figure 2:
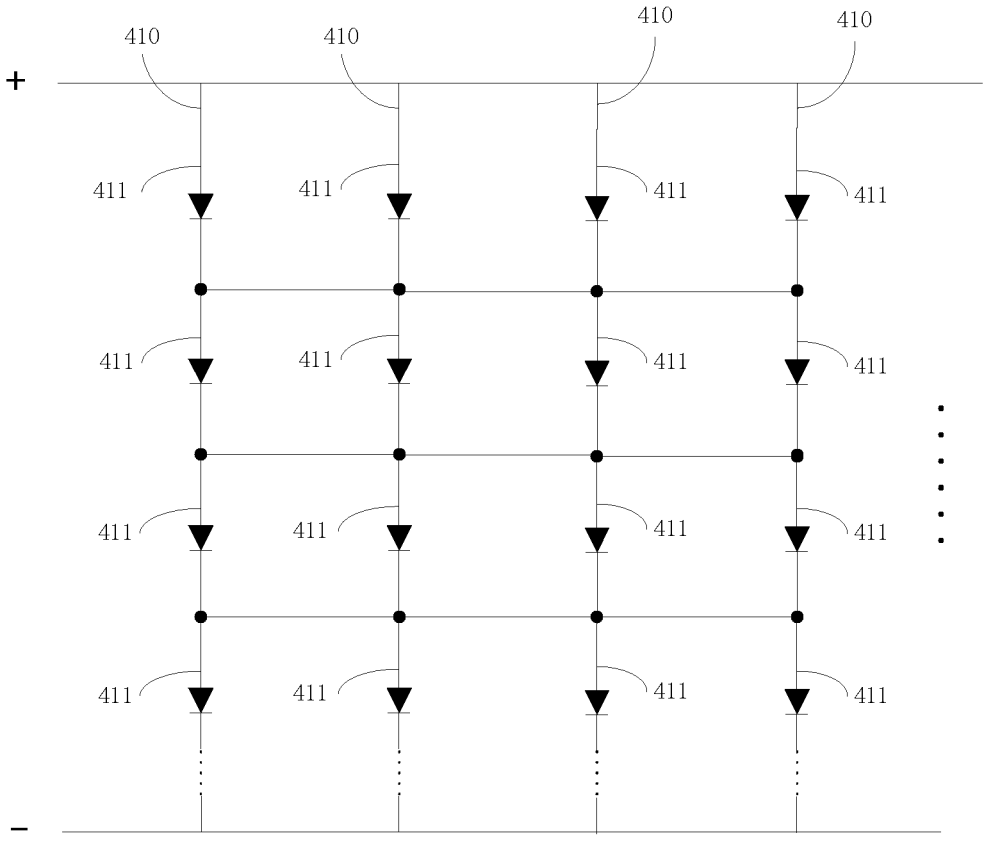
FIG. 2 is a structural schematic view of a conductive branch of FIG. 1.

Referring to FIG. 1 and FIG. 2, only parts related to embodiments of the present application are shown for ease of illustration. The LED traffic light 400 provided by an embodiment of the present application is driven by a control circuit. The control circuit includes a driving power supply 100 outputting direct current, and an accurate constant current module 200 configured to perform accurately constant current processing for the direct current output by the driving power supply 100. The LED traffic light 400 includes a plurality of conductive branches 410, the plurality of conductive branches 410 are connected in parallel at an output end of the accurate constant current module 200, and each of the conductive branches 410 is formed by connecting a power line with at least one light emitting diode 411.

The LED traffic light 400 adopts the driving power supply 100 outputting the direct current, the accurate constant current module 200 and the conductive branches 410 provided only with the power line and the light emitting diode 411, there is no need for connecting a resistor in series or in parallel, and the light emitting diode 411 can be driven directly by a direct current at a low voltage without the need for a built-in high-voltage AC/DC driving power supply. The LED traffic light 400 avoids the problems of transient high-voltage shock due to frequently turning on and turning off, and the open circuit, short circuit, emitting heat and easy damage of the AC/DC driving power supply, and can still keep working normally even if a housing of the lamp body of the LED traffic light 400 occurs water seepage, which not only improves the working reliability, response accuracy, safety and energy saving of the LED traffic light 400, but also reduces the faults such as flicker, light decay or LED damage or the like accordingly, thereby greatly prolonging the service life of the LED traffic light 400. The LED traffic light 400 adopts a DC to supply power and has lower power consumption, which can not only greatly reduce cable cost, but also abandon relevant high-voltage components, thereby being capable of saving the overall production cost of the LED traffic light 400. The wiring is simple, and there is no need to separately arrange a driving power supply inside the LED traffic light 400 during actual use, which can reduce the volume of the LED traffic light 400, and can also save a lot of installation and maintenance costs while saving the materials for manufacturing the housing of the LED traffic light 400.

Further, each of the conductive branches 410 includes a plurality of light emitting diodes 411 connected in series with each other, and two corresponding light emitting diodes 411 of adjacent two of the conductive branches 410 are connected in parallel, such that the plurality of light emitting diodes 411 are distributed in a grid shape in the plurality of conductive branches 410. Such a structure can ensure an equal voltage of each of the light emitting diodes 411 in parallel, can ensure uniform brightness of each of the light emitting diodes while reducing the line loss, thereby improving the illumination effect and correspondingly prolonging the service life of the light emitting diodes 411. In addition, the normal working of the other light emitting diodes 411 will not be affected when the light decay or damage occurs in a single light emitting diode 411, thereby further ensuring the working reliability of the entire LED traffic light.

In practical applications, the control circuit further includes a processing unit 300 outputting a control signal to the accurate constant current module 200. In an embodiment of the present application, the control and response time of the processing unit 300 for turning on/turning off the light emitting diodes 411 is greatly shortened, thereby further improving the safety and reliability for use. The processing unit 300 may be an MCU processor, a CPU processor, or other existing apparatus or device.

Further, a fault detection module 500 is included, which is respectively connected to an output end of the driving power supply 100, an output end of the processing unit 300 and an output end of the accurate constant current module 200 so as to monitor the plurality of conductive branches 410. The fault detection module 500 may monitor and control the plurality of conductive branches 410, and in particularly abnormal display and faults of the light emitting diodes 411 caused by possible external forces and special reasons may be accurately monitored all the time, thus the processing unit 300 may be triggered immediately to perform an emergency operation when a serious failure problem occurs due to a backstage control machine of the LED traffic light 400, a man-made factor and a special factor, thereby avoiding traffic accidents caused by the abnormal display and faults and improving the safety for use. The fault detection module 500 is preferably an existing fault detection board for weak current.

Further, the voltage of the direct current output by the driving power supply 100 is not higher than 60V. The use of the low-voltage direct current not higher than 60V can significantly improve the electrical safety level near the road, and there will be no risk of an electric shock when a worker operates in a case of electricity, thus further improving the safety for use.

In practical applications, the driving power supply 100 further includes an existing AC/DC conversion module 101. The AC/DC conversion module 101 may be used to convert the input alternating current into the direct current to provide the light emitting diodes 411 of the conductive branches 410 for displaying.

In practical applications, the LED traffic light 400 includes a lamp body provided with a circular lamp panel (not shown), and the light emitting diodes 411 are disposed on the circular lamp panel.

Further, the light emitting diodes 411 are distributed in a form of an annular array on the lamp panel. Such a structure can improve the utilization of the lamp panel to a certain extent, and correspondingly reduce the overall volume, thereby the structure is more compact and is beneficial to reduce the cost of materials.

The applicant has brought in a conclusion through a plurality of tests that the LED traffic light 400 of the present embodiment can save about 50% of the electric energy compared with the existing LED traffic light provided with a built-in high-voltage AC/DC driving power supply and resistors in series or in parallel, and that the outer housing can save about ⅓ of the material, which is of great economic significance for energy saving and environmental protection and reducing the production cost of the LED traffic light 400.

It should be noted that, in practical applications, the LED traffic light 400 further includes other required components or structures such as a housing, a lamp cover and the like, and these required components or structures are common in the technical field of lighting electrical appliances, and thus can be implemented by adopting corresponding existing technologies, which will not be described in detail herein.

The above description is only preferred embodiments of the present application, and is not intended to limit the present application. Any modification, equivalent substitution and improvement made within the spirit and principles of the present application are included within the protection scope of the present application.

What is claimed is:

1. An LED traffic light configured to be driven by a control circuit, wherein the control circuit comprises a driving power supply configured for outputting direct current, and an accurate constant current module configured to perform accurately constant current processing for the direct current output by the driving power supply, wherein the LED traffic light comprises a plurality of conductive branches connected in parallel at an output end of the accurate constant current module, and each of the conductive branches is formed by connecting a power line with at least one light emitting diode, wherein the control circuit further comprises a processing unit outputting a control signal to the accurate constant current module.

2. The LED traffic light according to claim 1, wherein, each of the conductive branches comprises a plurality of light emitting diodes connected in series with each other, and two corresponding light emitting diodes of adjacent two of the conductive branches are connected in parallel, such that the plurality of light emitting diodes are distributed in a grid shape in the plurality of conductive branches.

3. The LED traffic light according to claim 1, wherein, the processing unit is an MCU processing module.

4. The LED traffic light according to claim 1, wherein, the processing unit is a CPU processor.

5. The LED traffic light according to claim 1, wherein, the LED traffic light further comprises a fault detection module respectively connected to an output end of the driving power supply, an output end of the processing unit and an output end of the accurate constant current module such that the plurality of conductive branches are monitored.

6. The LED traffic light according to claim 1, wherein, the voltage of the direct current output by the driving power supply is not higher than 60V.

7. The LED traffic light according to claim 1, wherein, the LED traffic light comprises a lamp body provided with a circular lamp panel, and the light emitting diodes are disposed on the circular lamp panel.

8. The LED traffic light according to claim 7, wherein, the light emitting diodes are distributed in a form of an annular array on the lamp panel.

9. The LED traffic light according to claim 1, wherein, the driving power supply comprises an AC/DC conversion module.

10. The LED traffic light according to claim 2, wherein, the driving power supply comprises an AC/DC conversion module.

11. The LED traffic light according to claim 1, wherein, the driving power supply comprises an AC/DC conversion module.

12. The LED traffic light according to claim 3, wherein, the driving power supply comprises an AC/DC conversion module.

13. The LED traffic light according to claim 4, wherein, the driving power supply comprises an AC/DC conversion module.

14. The LED traffic light according to claim 5, wherein, the driving power supply comprises an AC/DC conversion module.

15. The LED traffic light according to claim 6, wherein, the driving power supply comprises an AC/DC conversion module.

16. The LED traffic light according to claim 7, wherein, the driving power supply comprises an AC/DC conversion module.

17. The LED traffic light according to claim 8, wherein, the driving power supply comprises an AC/DC conversion module.

* * * * *